US006016820A

United States Patent [19]

Knoll et al.

[11] Patent Number: 6,016,820

[45] **Date of Patent: *Jan. 25, 2000**

[54] AQUEOUS CLEANING SYSTEM

[75] Inventors: Frank Knoll, Huntington Station; Norman R. Wieder, Commack; Jeffrey F. Walsh, Central Islip, all of N.Y.

[73] Assignee: East/West Industries, Inc., Ronkonkoma, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/650,991

[22] Filed: May 21, 1996

Related U.S. Application Data

[60] Provisional application No. 60/001,179, Jul. 12, 1995.

[51] Int. Cl.[7] ..... B08B 3/04

[52] U.S. Cl. ..... 134/95.1; 134/109; 134/57 R; 210/636

[58] Field of Search ..... 134/95.1, 95.2, 134/109, 110, 111, 57 R; 210/636, 637, 638, 639, 660, 690, 748, 140

[56] References Cited

U.S. PATENT DOCUMENTS

| | | | |
|---|---|---|---|
| 4,349,434 | 9/1982 | Jaworski | 210/94 |
| 5,033,489 | 7/1991 | Ferre et al. | 134/57 R |
| 5,184,472 | 2/1993 | Guilbault et al. | 62/160 |
| 5,232,460 | 8/1993 | Botz | 8/141 |
| 5,246,023 | 9/1993 | Breunsbach et al. | 134/57 R |
| 5,544,421 | 8/1996 | Thompson et al. | 34/58 |
| 5,556,535 | 9/1996 | Van Der Est | 210/140 |
| 5,575,852 | 11/1996 | Chase | 118/680 |
| 5,593,598 | 1/1997 | McGinness et al. | 210/748 |

OTHER PUBLICATIONS

Fischer Scienitific Catalog, pp. 1266–1267, 1983.

Blackstone Electronics, Broadcaster, 1995, Issue 5, pp. 1–2.

Department of Defense, Military Standard Cleaning and Testing of Shipboard Oxygen, Nitrogen and Hydrogen Gas Piping Systems (MIL–STD–1330C(SH), Feb. 1, 1985 pp. iv–viii, 1, & 2.

*Primary Examiner*—Scott W. Houtteman

*Attorney, Agent, or Firm*—Cahn & Samuels, LLP

[57] ABSTRACT

An aqueous cleaning system and process for cleaning critical application gas systems and components, critical application fluid systems, and cryogenic systems. The aqueous cleaning system comprises multiple cleaning and rinsing stations, and a water purification and recycling system to implement a multi-step aqueous cleaning process. The multi-step aqueous cleaning process includes a pre-cleaning step, a rinsing step, a final cleaning step, and a final rinsing step. The rinsing step includes primary and secondary rinsing stages. The aqueous cleaning system is portable and self-contained and the aqueous cleaning process may be utilized in batch or lot type cleaning as well as in situ system level cleaning.

30 Claims, 4 Drawing Sheets

AQUEOUS CLEANING SYSTEM

This application claims the benefit of U.S. Provisional Patent Application No. 60/001,179 filed on Jul. 12, 1995.

BACKGROUND OF THE INVENTION

1. Field of the Invention

The present invention relates to an aqueous cleaning system and process, and more particularly, to an aqueous cleaning system and process for precision cleaning and testing of critical application gas systems including oxygen, nitrogen and hydrogen gas systems, critical application fluid systems, and cryogenic systems.

2. Discussion of the Prior Art

Surface vehicles, including military and commercial aircraft, and sub surface ships including military and commercial submarines, generally comprise oxygen, nitrogen and hydrogen gas systems. These gas systems must be cleaned and maintained in a clean condition according to predetermined standards. For example, military aircraft gas systems must meet certain well defined military standards for cleanliness as set forth in MIL-STD-1359. The gas systems are typically cleaned during routine maintenance cycles or between maintenance cycles if they are compromised through accidental contamination from water, fuels, lubricants, or any other foreign substance. Additionally, new components in the gas systems may also require cleaning prior to incorporation into the system. These components generally require cleaning because in a typical manufacturing process, such as machining, various substances are utilized to facilitate the process. For example, lubricants including cutting oil and grease are widely used in the machining process and leave a residue on the machined part. Manufacturing residues as well as other contaminants must be removed because of the potential dangers they pose; namely, health risks if the gas system is part of a breathing air system, and/or explosion risks since these gases are combustible or oxidizers.

Systems and processes for cleaning the above-described gas systems are well known and may be divided into two broad categories; namely, non-aqueous and aqueous. Cleaning systems and processes which fall into the non-aqueous category utilize specific chemicals to clean the gas systems or components thereof. Essentially, in a non-aqueous cleaning system and process, chemical agents may be flushed through the gas system for a given period of time at specific flow rates and pressures to remove the contaminants, or individual components comprising the gas systems may be submerged in tanks or vats containing the chemical agents to remove contaminants. The tanks or vats may be agitated to facilitate the cleaning process. Currently, certain chlorofluorocarbons are widely used as non-aqueous cleaners for cleaning gas systems or components thereof because of their excellent degreasing properties and the fact that they leave little or no residues. Two of the most common chlorofluorocarbons utilized today are trichlorotrifluoroethane (Freon-113®) and 1,1,1-trichloroethane (1,1,1-TCA). Both of these substances provide the high degree of cleaning required in the applications described above; however, these substances may pose a serious environmental threat. These substances are classified as Class I Ozone Depleting Substances (ODS), and depletion of the ozone layer may have profound detrimental consequences for the earth's inhabitants. The use and disposal of these hazardous substances are therefore governed under the strict standards of various international, federal, state, and local laws and regulations. Consequently, the potential harm from these substances along with the costs associated with the use of the substances, the taxes, and the disposal of these substances, which is approximately $7,500.00 for a 55 gallon drum, necessitate the need for alternative cleaning systems and processes. In addition, international, and federal laws will require the eventual phasing out of chlorofluorocarbon use.

Given the concerns associated with non-aqueous cleaning systems and processes, the use of aqueous cleaning systems and processes are becoming more prevalent. In aqueous cleaning systems and processes, water and various water soluble cleaning agents may be flushed through the gas system for a given period of time at specific flow rates to remove the contaminants, or individual components comprising the gas systems may be submerged in tanks or vats containing the water and water soluble cleaning agents to remove contaminants. The tanks or vats may be agitated to facilitate the cleaning process. The operation of the aqueous cleaning system is similar to that of the operation of the non-aqueous cleaning system and process described above; however, in the aqueous cleaning system and process, multiple flushing and rinsing cycles are necessary to achieve the same level of cleanliness as the non-aqueous cleaning system provides, thereby producing large quantities of waste water. In addition, while the water soluble cleaning agents themselves do not pose an environmental threat, the contaminants removed in the cleaning process typically do pose at least some environmental risks. Accordingly, similar to the disposal of the chemical waste discussed above, large quantities of waste water containing water soluble cleaning agents and contaminants must be treated in accordance with various federal, state and local laws and regulations before being returned to nearby waterways or to the ground water. Therefore, as with the case described above, cost may become the deciding factor.

Another problem associated with currently existing aqueous cleaning systems and processes is a lack of flexibility. Generally, currently existing aqueous cleaning systems are housed within large laboratory type environments. Consequently, remote cleaning, for example, on the flightline, is not possible. A typical situation where this problem might arise is in the case where a component or multiple components of a gas system needs to be replaced quickly on the flightline. The component or components may have been coated with a chemical to prevent corrosion during storage or while awaiting subsequent processing, and therefore may not have been cleaned initially. Accordingly, the component or components would have to be taken back to the laboratory for cleaning thereby contributing to aircraft downtime.

SUMMARY OF THE INVENTION

In accordance with a first aspect, the present invention is directed to a process for cleaning systems or system components. The process includes contacting the systems or system components with a water soluble pre-cleaning solution and a water soluble final cleaning solution to remove contaminants from the systems or system components, rinsing the systems or system components with a rinsing solution to remove contaminants or the water soluble pre-cleaning and final cleaning solutions from the systems or system components, purifying the used cleaning and rinsing solutions to generate purified water and reduced volume waste, and returning the purified water to at least one of the water soluble pre-cleaning solution, the water soluble final cleaning solution, and the rinse solution.

In accordance with a second aspect, the present invention is directed to a process for cleaning systems or system components. The process comprises containing a water soluble pre-cleaning solution comprising water and a water soluble cleaning solution in a container, directing the water soluble pre-cleaning solution from the container through a first purification assembly, contacting the systems or system components with the water soluble pre-cleaning solution to remove contaminants from the systems or system components, rinsing the systems or system components with a rinse solution to remove the water soluble pre-cleaning solution from the system components, and directing the used water soluble pre-cleaning solution through a second purification assembly. The first purification assembly purifies the water soluble pre-cleaning solution and returns the purified water soluble pre-cleaning solution to the container. The second purification assembly generates purified water and reduced volume waste and returns the purified water to the container.

In accordance with a third aspect, the present invention is directed to a process for cleaning systems and system components. The process comprises contacting the systems or system components with a water soluble pre-cleaning solution to remove contaminants from the systems or system components, transferring the systems or system components to a clean room upon completion of contacting the systems or system components with the water soluble pre-cleaning solution, and contacting the systems or system components in the clean room with a water soluble final cleaning solution to remove contaminants from the systems or system components. The water soluble pre-cleaning solution comprises at least a first water soluble cleaning agent.

In accordance with a fourth aspect, the present invention is directed to a cleaning system for cleaning systems or system components. The cleaning system comprising a first cleaning assembly, a second cleaning assembly, a rinsing assembly, and a water processing assembly. The first cleaning assembly is cooperatively arranged to contact the systems or system components with a water soluble pre-cleaning solution comprising water and a water soluble cleaning agent to remove contaminants from the systems or system components. The second cleaning assembly is cooperatively arranged to contact the systems or system components with a water soluble final cleaning solution to remove contaminants from the systems or system components. The rinsing assembly is cooperatively arranged to rinse systems or system components with a rinsing solution comprising water to remove contaminants, the water soluble pre-cleaning solution or the water soluble final cleaning solution from the systems or system components. The water processing assembly is coupled to at least one of the first cleaning assembly, the second cleaning assembly, and the rinsing assembly to purify the used water soluble cleaning or rinsing solutions to generate purified water and reduced-volume waste and to return the purified water to one of the water soluble pre-cleaning solution, the water soluble final cleaning solution, and the rinse solution.

In accordance with a fifth aspect, the present invention is directed to a cleaning system for cleaning systems or system components. The cleaning system comprises a first cleaning assembly, a second cleaning assembly, a rinsing assembly, and a water processing assembly. The first cleaning assembly is cooperatively arranged to contact the systems or system components with a water soluble pre-cleaning solution comprising water and a water soluble cleaning agent to remove contaminants from the systems or system components. The first cleaning assembly includes a first container to hold the water soluble pre-cleaning solution and the systems and system components, a first purification assembly connected to and communicating with the first container to purify the water soluble pre-cleaning solution and return the purified water soluble pre-cleaning solution to the first container, and a first flushing unit to deliver the water soluble pre-cleaning solution to the systems and system components. The second cleaning assembly is cooperatively arranged to contact the systems or system components with a water soluble final cleaning solution to remove contaminants from the systems or system components. The second cleaning assembly includes a second container to hold the water soluble final cleaning solution and the systems and system components, a second purification assembly connected to and communicating with the second container to purify the water soluble final cleaning solution and return the purified water soluble final cleaning solution to the second container, and a second flushing unit to deliver the water soluble final cleaning solution to the systems and system components. The rinsing assembly is cooperatively arranged to rinse the systems or system components with a rinsing solution comprising water to remove contaminants, the water soluble pre-cleaning solution, or the water soluble final cleaning solution from the systems or system components. The water processing assembly is cooperatively arranged to purify the used cleaning and rinsing solutions to generate purified water and reduced-volume waste. The water processing assembly being connected to and communicating with the first cleaning assembly, the second cleaning assembly, and the rinsing assembly.

In accordance with a sixth aspect, the present invention is directed to a portable, self-contained aqueous cleaning system for cleaning systems or system components. The portable, self-contained aqueous cleaning system comprising a first cleaning assembly, a second cleaning assembly, a trailer, and a transfer assembly. The first cleaning assembly is cooperatively arranged to contact the systems or system components with a water soluble pre-cleaning solution to remove contaminants from the systems or system components. The second cleaning assembly is cooperatively arranged to contact the systems or system components with a water soluble final cleaning solution to remove contaminants from the systems or system components. The trailer includes a clean room which houses the second cleaning assembly, and a gray room which houses the first cleaning assembly. The transfer assembly is positioned between the clean and gray rooms for transferring systems or system components therebetween.

In an exemplary embodiment, the aqueous cleaning system of the present invention utilizes a mixture of water and water soluble cleaning agents or solutions to implement a safe, efficient, and cost effective process for cleaning critical application gas systems and components. The exemplary aqueous cleaning system does not utilize chemical cleaning agents which release volatile organic compounds or ozone depleting substances which may harm the environment. The exemplary aqueous cleaning system and process makes use of water soluble cleaning agents which are non-toxic, non-flammable (even under pressure), biodegradable, and which contain no presently identified environmentally hazardous constituents. Additionally, the exemplary aqueous cleaning system and process greatly reduces cleaning waste through successive filtration and recycling of the water. Accordingly, the cost of implementing the cleaning process as well as complying with all applicable laws and regulations concerning disposal of the generated waste is greatly reduced, and the environment protected.

The exemplary aqueous cleaning system and process of the present invention meets or exceeds all military and commercial standards for the cleaning of critical application gas systems and components. The mixture of water and water soluble cleaning agents utilized in the process are compatible with all metallic materials and many non-metallic materials comprising critical application gas systems. The mixture is completely rinseable with water so that no residue is left, thereby ensuring no reaction with the particular gas. In addition, the mixture and the gas system components may be easily analyzed utilizing existing quality control verification inspections and tests to ensure the required level of cleanliness.

The exemplary aqueous cleaning system and process of the present invention provides for a versatile means for cleaning critical application gas systems and components. The exemplary aqueous cleaning system and process may be utilized in batch or lot type cleaning applications as well as in situ gas system level cleaning applications. The exemplary aqueous cleaning system may be housed within a portable structure that may be towed or driven to remote sites for the in situ cleaning of gas systems and components. The exemplary aqueous cleaning system may be a self-contained system which may be utilized to implement the cleaning process at remote sites.

DESCRIPTION OF THE PREFERRED EMBODIMENT

In an exemplary embodiment, the aqueous cleaning system of the present invention utilizes a combination of water and aqueous cleaning solutions such as water soluble cleaning agents or solutions to implement a unique process for efficiently cleaning critical application gas systems. Specifically, the aqueous cleaning system may be utilized to implement a process for cleaning oxygen, nitrogen and hydrogen gas system piping, components, and assemblies utilized in surface ships, including military and commercial aircraft, and sub surface ships, including military and commercial submarines, for example, in accordance with all applicable military and commercial standards. Additionally, the aqueous cleaning system and process may be utilized to clean critical application fluid systems including medical equipment such as breathing air systems which are utilized to deliver air and anesthetic agents to a patient undergoing general anesthesia, and cryogenic systems. The exemplary aqueous cleaning system may be housed within a portable structure which may be easily transportable for implementing the cleaning process at remote sites. For example, the exemplary aqueous cleaning systems may be housed within a trailer, motorized vehicles such as trucks, non-motorized vehicles, or any other suitable vehicle approved by the Department of Transportation for use over existing roads and bridges. The trailer may be small enough to maneuver, i.e., portable, about an airfield or hanger, thereby enabling the portable, self-contained cleaning system to operate on the flightline. Additionally, the trailer may be small enough to maneuver around the deck of a ship.

The portable, self-contained aqueous cleaning system may implement the cleaning process in one or more modes of operation. For example, in a first mode of operation, components of the particular gas system are cleaned individually in a series of cleaning and rinsing steps. This type of cleaning process may be described as batch or lot type cleaning. In a second mode of operation, the portable, self-contained aqueous cleaning system may be connected to the gas system in situ, whereby one or more subsystems or even the entire gas system may be cleaned as a whole.

Figure 1:
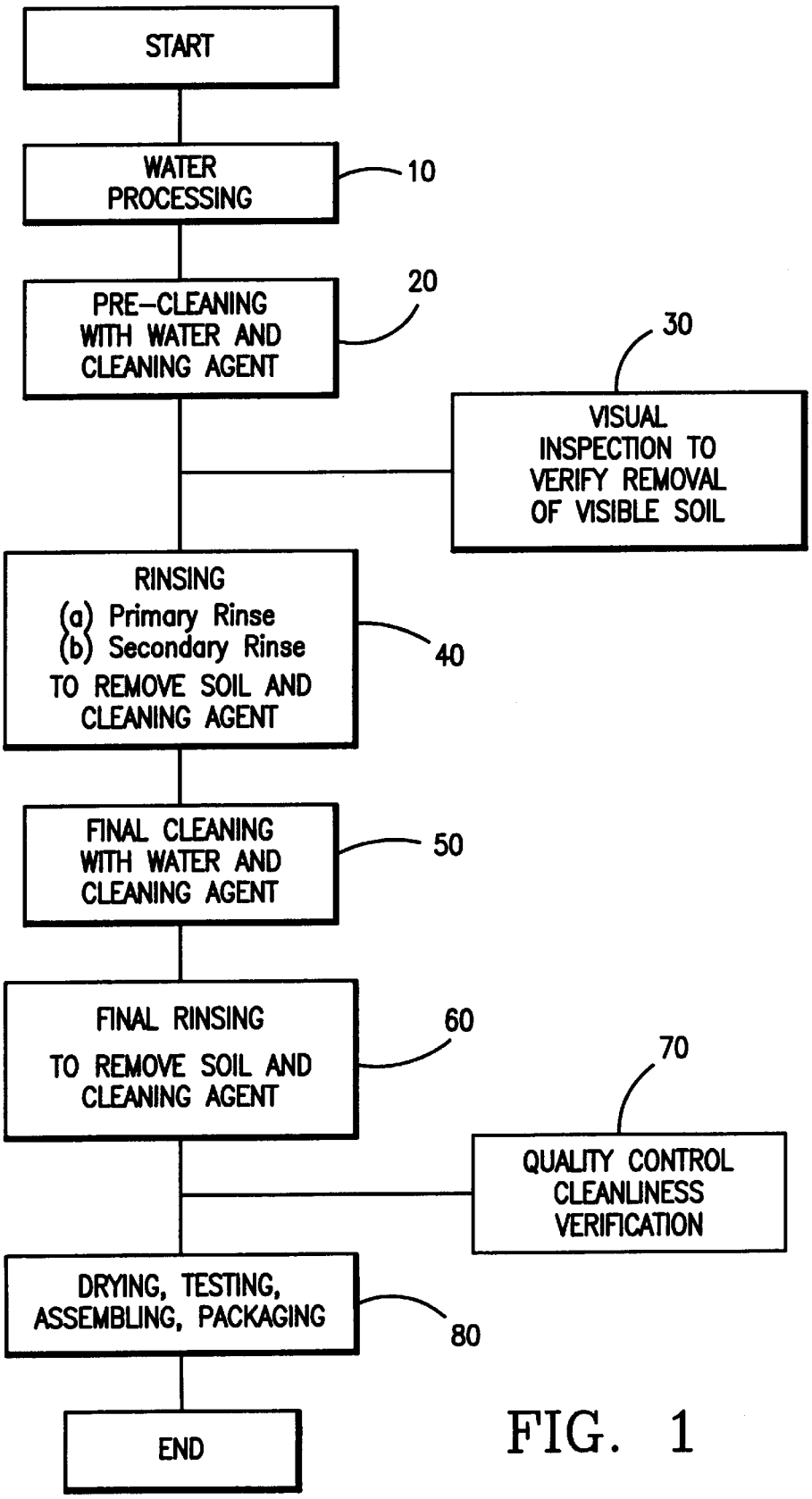
FIG. 1 is a flow chart representation of the aqueous cleaning process of the present invention.

FIG. 1 is a flow chart illustrating an exemplary embodiment of the overall aqueous cleaning process and associated inspections and verification tests. The flow chart provides a broad overview of the aqueous cleaning process which is equally applicable to the two modes of operation discussed above. The first step in the aqueous cleaning process is water processing, as indicated in block 10. In this step, the water to be utilized in the aqueous cleaning process is purified and heated for optimal results. A detailed description of the water processing step is given subsequently. The second step in the aqueous cleaning process is pre-cleaning, as indicated in block 20. In this step, the gas system piping, components, and/or assemblies are cleaned with a mixture of the purified water and a water soluble cleaning agent, such as a mixture comprising filtered, de-ionized, and heated water and a first water soluble cleaning agent, to remove contaminants such as oils and greases. The term solution shall be understood to mean a uniformly dispersed mixture, at the molecular or ionic level, of one or more substances, i.e., cleaning agent, in one or more other substances. Accordingly, a water soluble solution shall be understood to mean a solution comprising water as one of the substances. Upon completion of the pre-cleaning step, a visual inspection of the gas system piping, components, and/or assemblies may be performed, as indicated in block 30. During this phase, the gas system piping, components, and/or assemblies are inspected by a technician to verify that all visible contaminants have been removed. If there are still visible contaminants, the pre-cleaning step may be repeated. If all visible contaminants have been removed, the gas system piping, components, and/or assemblies undergo the next step in the aqueous cleaning process which is the rinse step, as indicated by block 40. In the rinse step, the gas system piping, components, and/or assemblies are subjected to a primary rinse and a secondary rinse to remove remaining contaminants and/or water soluble cleaning agent residues. The primary and secondary rinses preferably utilize only the filtered, de-ionized and heated water. Upon completion of both stages of the rinse step, the gas system piping, components, and/or assemblies are preferably cleaned again in the next step which is the final cleaning step indicated by block 50. In the final cleaning step, the gas system piping, components, and/or assemblies are cleaned utilizing a second water soluble cleaning agent. The second water soluble cleaning agent may be utilized in diluted form, i.e., mixed with water, or in concentrated form, i.e., no water added. The final cleaning step ensures the removal of any residual deposits, prevents contaminant redeposition, and ensures an easily rinseable surface. Upon completion of the final cleaning step, the gas system piping, components, and/or assemblies are rinsed again in the fourth and final step which is the final rinse step indicated by block 60. In the final rinse step, all remaining residues may be removed by the filtered, de-ionized, and heated water. Upon completion of the final rinse, the gas system piping, components, and/or assemblies may be subjected to multiple quality control cleanliness verification tests as indicated by block 70. If any of the verification tests are failed, the entire cleaning process may be repeated. If all of the verification tests are passed, the gas system piping, components, and/or assemblies are dried and packaged or dried and installed in the gas system as indicated by block 80. The gas system piping, components and/or assemblies may be dried with an inert purge gas, such as nitrogen, and heated in an oven. If an entire gas system was cleaned in situ, and all verification tests passed, then the gas system would be dried by blowing a heated filtered inert gas, such as nitrogen, through the gas system.

The contaminated waste by-products of the aqueous cleaning process are collected in a drum or other container and processed through a filter, such as a nanofiltration membrane. Thereafter, the permeate is ported to a water supply tank for reuse in the aqueous cleaning process, and the retentate is collected in a waste drum. One of the important advantages of the invention is that the volume of the retentate is much smaller than the volume of the permeate. The retentate may, for example, comprise a mixture of the first and second water soluble cleaning agents, which are preferably non-toxic and biodegradable, and the various contaminants removed during the cleaning process. This concentrated waste may then be disposed of in accordance with all applicable federal, state, and local laws and regulations.

Figure 2:
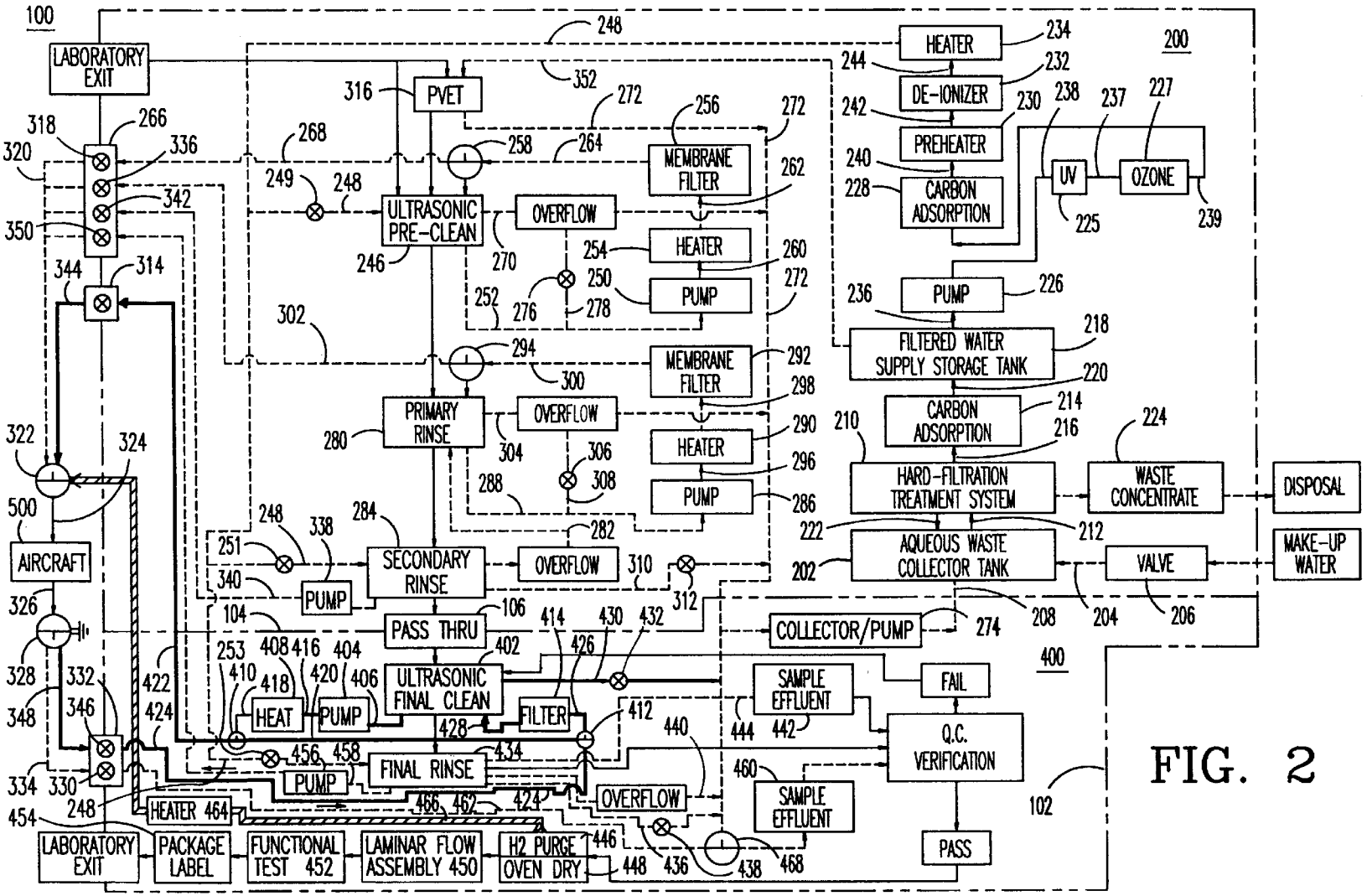
FIG. 2 is a block diagram of the portable, self-contained aqueous cleaning system of the present invention.

A detailed description of the aqueous cleaning process and associated verification tests and procedures is given below with respect to an exemplary embodiment of the portable, self-contained aqueous cleaning system illustrated, in block diagram format, in FIG. 2. The portable, self-contained aqueous cleaning system 100 may be housed within a trailer 102. The trailer 102 is preferably divided into two separate rooms 200 and 400 by an airtight partition 104. The one room 200 is referred to as the gray room and the other room 400 is referred to as the clean room. The gray room 200 preferably comprises all of the aqueous cleaning system elements which implement the pre-cleaning and rinsing steps discussed above, and the water processing elements of the aqueous cleaning system 100. The clean room 400 preferably comprises all of the aqueous cleaning system elements which implement the final cleaning step, the final rinse step, and the quality control verification tests discussed above. The aqueous cleaning system elements which implement the final cleaning and rinsing steps are housed within the clean room 400 to prevent contamination of the materials utilized in these steps.

In order for a room to qualify as a clean room, the air in the room must meet certain predetermined levels of cleanliness. The level of air cleanliness is typically specified by the maximum number of specific size particles per cubic foot of air. There are a multitude of alternative classes for airborne particulate cleanliness. The level of cleanliness for the clean room 400 of the exemplary aqueous cleaning system 100 may be in the range of 0.283 and 2.83 half micron particles per cubic foot of air, and preferably, the level of cleanliness for the clean room 400 may not exceed one half micron particle per cubic foot of air.

In the interests of clarity, the detailed description of the aqueous cleaning process is divided into two sections. In the first section, the description of the aqueous cleaning system and process is given in terms of batch or lot type cleaning. In other words, the system and process are discussed in terms of cleaning individual parts of gas systems in contrast to cleaning the one or more subsystems or the entire gas system. In the second section, the description of the aqueous cleaning system and process is given in terms of system level cleaning, i.e., cleaning subsystems or the gas system as a whole. Although the processes and the elements which implement the processes may be different, the water utilized in each cleaning process is preferably the same. Accordingly, a description of the water processing procedure and the water processing elements of the portable, self-contained aqueous cleaning system is given only once as set forth below.

WATER PROCESSING

The exemplary portable, self-contained aqueous cleaning system 100 may be a substantially closed system, i.e., the water used in the cleaning process is "cleaned" and reused. The aqueous cleaning system 100 is referred to as a substantially closed system because some water may be lost in the cleaning process. For example, water may be lost by evaporation, and water may be lost during waste disposal. However, as is explained below, the majority of the water is preferably conserved. In the exemplary embodiment illustrated in FIG. 2, the water to be utilized in the aqueous cleaning process may be stored in an aqueous waste tank 202. The aqueous waste tank 202 may comprise a drum or any other container suitable for holding water. The aqueous waste tank 202 may also comprise a water supply line 204 and an on/off valve 206 for initially filling or adding make-up water to the aqueous waste tank 202 from external water supplies as needed. Additionally, the aqueous waste tank 202 may comprise a return line 208 which carries water contaminated during the aqueous cleaning process back into the aqueous waste tank 202 for eventual reuse.

The water in the aqueous waste tank 202 may be contaminated water or it may be fresh water. In either case, however, the water is typically not "clean" enough for use in the aqueous cleaning process. Accordingly, the water in aqueous waste tank 202 may be filtered to remove contaminants that may interfere with the aqueous cleaning process. The water in the aqueous waste tank 202 may be purified by various means, including purifiers, such as a sorbent or ion-exchange bed, and/or filters, such as microfilters, nanofilters, and/or a reverse osmosis filter. In the exemplary embodiment illustrated in FIG. 2, a nanofilter treatment system 210 may be connected to the aqueous waste tank 202 to provide the desired filtration. The nanofilter treatment system 210 may comprise a nanofilter and a pump which draws water from the aqueous waste tank 202 via a conduit 212. The pump may be actuated by a float switch positioned in the aqueous waste tank 202. The nanofilter preferably comprises a membrane, such as polysulphone, which removes or traps particulate matter as small as ten angstroms, i.e., contaminants in the molecular size range. The water exiting the nanofilter, i.e., permeate, may then be pumped through a carbon adsorption unit 214 via a conduit 216 and into a filtered water supply storage tank 218 via a conduit 220. The water which does not pass through the nanofilter, i.e., retentate, drains back into the aqueous waste collector tank 202 via a drain conduit 222. Periodically, the particulate matter collected by the nanofilter may be removed to a small waste concentrate tank 224 where it is held for disposal in accordance with appropriate local, state, and federal laws and regulations. The small waste concentrate tank 224 may comprise a level indicator to prevent an accidental spill or overflow of the material in the tank 224.

The carbon adsorption unit 214 comprises a carbon adsorption bed which preferably includes activated carbon containing a bactericide, such as silver nitrate, and removes various chemical contaminants and any bacterial growth that may have occurred during long term storage of the water in the aqueous waste collector tank 202. Accordingly, the water in the filtered water supply storage tank 218 may only contain ionic constituents such as metal ions and aqueous salts that are small enough to have passed through the nanofilter and the adsorption bed 214.

The water utilized in the aqueous cleaning process may be drawn by a pump 226 from the filtered water supply storage tank 218 via a conduit 236 and ported through an ultraviolet sterilizing unit 225, an ozone injection unit 227, a second carbon adsorption unit 228, a first water processing heating unit 230, a de-ionizing filter 232, and a second water processing heating unit 234 via a series of conduits 238, 237, 239, 240, 242, and 244, respectively. The pump 226 may draw the water from the filtered water supply storage tank 218 at a rate of five to ten gallons per minute, and preferably at a rate of five gallons per minute. The ultraviolet sterilizing unit 225 may be utilized to destroy any remaining bacterial contamination in the water. The ozone injection unit 227 works in combination with the ultraviolet sterilizing unit 225 to remove organic constituents therefrom. The ozone injection unit 227 directs ozone into the water upon exiting the ultraviolet sterilizing unit 225 thereby oxidizing both organic and inorganic substances. Ozone is an outstanding bactericide and virus deactivant. The ultraviolet sterilizing unit works through photo oxidation of exposed water molecules. Hydroxyl free radicals ($OH^-$) are generated which attack and breakdown carbon bonds turning bacterial and other organic contaminants remaining in the water into carbon dioxide ($CO_2$) which may be removed by the de-ionizing filter 232. The second carbon adsorption unit 228 may also include a bactericide which removes any remaining bacterial growth that may have occurred during long term storage of the water in the filtered water supply storage tank 218. The first water processing heating unit 230 may comprise a standard manifold heater. The first water processing heating unit 230 raises the temperature of the water to a value in the range of seventy-five to one hundred fifty degrees Fahrenheit, and preferably to a value in the range of seventy-five to ninety degrees Fahrenheit for efficient de-ionization. The de-ionizing filter 232 removes the ions which may not have been removed by the nanofilter of the nanofiltration treatment system 210. The water exiting the de-ionizing filter 232 may contain particulate matter smaller than one angstrom; however, contaminants of this size do not pose a problem in critical application gas system cleaning processes. The second water processing heating unit 234 may also comprise a manifold heater. The second water processing heating unit 234 raises the temperature of the water to a value in the range of one hundred ten to one hundred eighty degrees Fahrenheit, and preferably to a value in the range of one hundred ten to one hundred twenty degrees Fahrenheit for use in the aqueous cleaning process. Two heating units 230, 234 are preferred because the temperature of the water for the aqueous cleaning process may be too high for the de-ionizing filter 232; accordingly, the second water processing heating unit 234 raises the temperature of the water after deionization. The second water processing heating unit 234 is adjustable to maintain the applicable aqueous cleaning process temperatures. Accordingly, the water exiting the second water processing heating unit 234, now referred to as process water, preferably surpasses all applicable commercial and military requirements for purity and is at or near the required temperatures for efficient cleaning. Note that the water in filtered water supply storage tank 218 may be used for other purposes.

BATCH LEVEL CLEANING

The first step in the exemplary aqueous cleaning process, as stated above, is the pre-cleaning step. The pre-cleaning step comprises removing the bulk of the various contaminants, such as oil and grease, from the components of the particular gas system. The pre-cleaning step preferably removes all visible contaminants from the gas system components. In the pre-cleaning step at the batch level, the gas system components are deposited into a pre-cleaning tank 246 which is filled with a mixture of process water and a first water soluble cleaning agent, for example, a non-toxic, biodegradable compound such as DOT 111/113 Aqueous Cleaner. Other water soluble cleaning agents may be utilized, but it is preferable that the cleaning agent be non-toxic and biodegradable. DOT 111/113 is an effective cleaning agent for removing light to heavy concentrations of oils and greases from metallic, rubber, plastic, acrylic, polyvinyl, and other materials. The pre-cleaning tank 241 may be located in the gray room 200. The gas system components may be deposited into the pre-cleaning tank 246 by a technician or by an automated system such as a conveyor belt or robotic manipulator. In the exemplary embodiment, the pre-cleaning tank 246 may be a fifteen gallon tank; however, the pre-cleaning tank 246 may be of any size to accommodate different applications. The pre-cleaning tank 246 may be filled with process water via a conduit 248 connected to the second water processing heater 234, and the first water soluble cleaning agent may be added manually by a technician or by an automatic dispenser such as a pump. An on/off valve 249 may be connected in line with the branch of the conduit 248 connected to the pre-cleaning tank 246. The on/off valve 249 may be opened to fill the pre-cleaning tank 246 and closed when the tank 246 is full. The on/off valve 249 may also be utilized to control the flow rate of the water entering the tank 246. The on/off valve 249 may be a manually actuated valve or an automatically actuated valve. In the exemplary embodiment, with the on/off valve 249 fully open, the water may enter the tank 246 at a rate of five to ten gallons per minute, and preferably at a rate of five gallons per minute. The first water soluble cleaning agent may be diluted to various concentrations depending on the particular application. In the preferred embodiment, there is a fifteen to one ratio of process water to water soluble cleaning agent. A submersible ultrasonic transducer may be mounted in the pre-cleaning tank 246 to generate vibratory motion in the mixture of process water and the first water soluble cleaning agent, i.e., the water soluble pre-cleaning solution. This vibratory motion facilitates the cleaning process through a very fine scrubbing action caused when cavitation bubbles implode. Other means, for example, a mechanical agitator, may be utilized to generate motion in the pre-cleaning tank 246. Additionally, the water soluble pre-cleaning solution may be continuously recirculated by a pump 250 which draws the water soluble pre-cleaning solution from the pre-cleaning tank 246 through a drain line 252 and circulates it through a heating unit 254, a filter 256, and back into the pre-cleaning tank 246 through a two-way valve 258. The recirculation of the water soluble pre-cleaning solution also facilitates the cleaning process.

In the exemplary embodiment, the pump 250 circulates the water soluble pre-cleaning solution at a rate of up to five gallons per minute and preferably at a rate of at least one gallon per minute. The heating unit 254 may be connected to the output side of the pump 250 via a conduit 260. The heating unit 254, which may comprise a manifold heater, preferably maintains the temperature of the fluid at a value in the range of one hundred ten to one hundred eighty degrees Fahrenheit, and preferably to a value in the range of one hundred ten to one hundred twenty degrees Fahrenheit for effective cleaning. The heating unit 254 may be connected to the filter 256 via a conduit 262. The filter 256 preferably comprises a polypropylene filter which is operable to remove particulate matter in the five micron range from the water soluble pre-cleaning solution. The filter 256 may be connected to the two-way valve 258 via a conduit 264. The two-way valve 258 may be a manually actuated valve or an automatically actuated valve. In either case, the two-way valve 258 directs the water soluble pre-cleaning solution into the per-cleaning tank 246 or to an on/off valve manifold 266 via a conduit 268. In batch or lot type cleaning, the water soluble pre-cleaning solution is recirculated; whereas if the gas system is to be cleaned as a whole, the water soluble pre-cleaning solution is directed to the on/off valve manifold 266 for connection to an input or output of the gas system, as is explained in detail subsequently. An overflow line 270 may be connected to the pre-cleaning tank 246 to port overflow water soluble pre-cleaning solution to a system return line 272. The system return line 272 may be connected to a return pump 274 which ports the fluid in the system return line 272 to the return line 208 connected to aqueous waste tank 202. The overflow line 270 may also be connected through an on/off valve 276 and conduit 278 to the drain line 252. Accordingly, if the on/off valve 276 is closed, the water soluble per-cleaning solution is recirculated via the pump 250, and if open, the water soluble pre-cleaning solution is ported to the aqueous waste collector tank 202.

The gas system components may remain, i.e., soak, in the pre-cleaning tank 246 for any suitable period of time, e.g., from between five to thirty minutes, and preferably from between ten to fifteen minutes. After this time period, the components are removed from the pre-cleaning tank 246 by a technician or by an automated system, and subject to a visual inspection by a technician. The gas system components may be visually inspected to determine the presence of rust scale, dirt, paints, preservatives and organic materials such as grease, oil, ink and dye. The presence of such deposits indicate recleaning of the component is desirable.

If the gas system component or components fail the visual inspection by the technician, the component or components may be returned to the per-clean tank 246 for another pre-clean cycle. Alternatively, or in addition, the component or components may be scrubbed with a brush, such as a nylon brush, to help remove difficult deposits. If, however, the gas system components pass the visual inspection test, the components are moved into a primary rinse tank 280 for implementation of the first stage of the rinse step.

The second step in the exemplary aqueous cleaning of the process is the rinse step which preferably comprises the primary rinse stage and the secondary rinse stage. The rinse step is intended to remove additional contaminants and/or water soluble cleaning agent residues left from the per-cleaning step. In the primary rinse stage, as stated above, the gas system components are deposited into the primary rinse tank 280 which may be located in the gray room 200. Once again, the gas system components may be deposited into the primary rinse tank 280 by a technician or by an automated system. The primary rinse tank is preferably filled with process water only. In the exemplary embodiment, the primary rinse tank 280 is a fifteen gallon tank; however, as is the case with the pre-cleaning tank 246, the primary rinse tank 280 may be of any size to accommodate different applications. The primary rinse tank 280 may be filled with process water via an overflow line 282 connected between the primary rinse tank 280 and a secondary rinse tank 284. The secondary rinse tank 284 may be filled with process water via the conduit 248 connected to the second water processing heating unit 234. Essentially, process water is pumped through the second water processing heating unit 234 into the secondary rinse tank 284 through an on/off valve 251, thereby filling the secondary rinse tank 284. Additional process water is added to the secondary rinse tank 284 and ported through the overflow line 282, thereby filling the primary rinse tank 280. Unlike the per-cleaning step, process water may be continuously circulated through the primary and secondary rinse tanks 280 and 284. The process water exiting the second water processing heating unit 234 flows through the conduit 248, through the on/off valve 251, and into the secondary rinse tank 284 and the primary rinse tank 280. The on/off valve 251 may be utilized to control the flow rate of the process water into the secondary and primary rinse tanks 284 and 280. The on/off valve 251 may be a manually actuated valve or an automatically actuated valve. The flow rate may be no greater than one gallon per minute, and preferably a half gallon per minute. Additionally, in order to facilitate the rinsing of the components, the process water may be continuously recirculated by a pump 286 which draws the process fluid from the primary rinse tank 280 through a drain line 288, and circulates it through a heating unit 290, a filter 292, and back into the primary rinse tank 280 through a two-way valve 294. The primary rinse tank 280 may also be filled directly via a separate line (not illustrated). Accordingly, the process water in the primary rinse tank 280 may be recirculated, and fresh process water continuously added to ensure an effective rinse.

In the exemplary embodiment, the pump 286 circulates the process water at a rate of up to five gallons per minute and preferably at a rate of at least one gallon per minute. The heating unit 290 may be connected to the output side of the pump 286 via a conduit 296. The heating unit 290, which may comprise a manifold heater, preferably maintains the temperature of the process water at a value in the range of one hundred ten to one hundred eighty degrees Fahrenheit, and preferably, at a value in the range of one hundred ten to one hundred twenty degrees Fahrenheit for effective rinsing. The heating unit 290 may be connected to the filter 292 via a conduit 298. The filter 292 preferably comprises a polypropylene filter which is operable to remove particulate matter in the five micron size range from the process water. The filter 292 may be connected to the two-way valve 294 via a conduit 300. The two-way valve 294 may be a manually actuated valve or an automatically actuated valve. In either case, the two-way valve 294 either directs the process water into the primary rinse tank 280 or to the on/off valve manifold 266 via a conduit 302. In batch or lot type cleaning, the process water is recirculated, whereas if the gas system is to be cleaned as a whole, the process water is directed to the on/off valve manifold 266 for connection to an input or output of the gas system. An overflow line 304 may be connected to the primary rinse tank 280 to port overflow process water to the system return line 272 for return to the aqueous waste collector tank 202 as explained above. The overflow line 304 may also be connected through an on/off valve 306 and conduit 308 to the drain line 288. Accordingly, if the valve 306 is closed, the process water is recirculated via the pump 286, and if open, the process water is ported to the aqueous waste collector tank 202.

The gas system components may remain, i.e., soak, in the primary rinse tank 280 for any suitable period of time, e.g., from between five to thirty minutes, and preferably from between ten to fifteen minutes. After this time period, the components are removed from the primary rinse tank 280 and deposited into the secondary rinse tank 284 which may also be located in the gray room 200. As before, the gas system components may be removed from the primary rinse tank 280 and deposited into the secondary rinse tank 284 by a technician or an automated system. Typically, no inspections or tests are done between the primary and secondary rinse stages.

The secondary rinse stage is intended to remove any contaminants or residues remaining after the primary rinse stage. A two stage rinsing step may be necessary because of the nature of the process water. The process water is filtered and de-ionized; consequently, it will rapidly draw the contaminants and water soluble cleaning agent into solution, thereby fouling the water. Therefore, in order to achieve an effective rinse step, it is preferable to implement the rinse step in two stages. As explained above, the gas system components may be deposited into the secondary rinse tank 284 which is preferably filled with process water only. In the exemplary embodiment, the secondary rinse tank 284 is a fifteen gallon tank, however, as in the case of the primary rinse tank 280, the secondary rinse tank 284 may be of any size to accommodate different applications. A drain line 310 and an on/off valve 312 may be connected between the secondary rinse tank 284 and the system return line 272 for porting the process water in the secondary rinse tank 284 to the aqueous waste collector tank 202. Unlike the primary rinse stage, the process water may not be circulated during the secondary rinse stage, i.e., there is no separate pump, heater, and membrane filter combination. However, water is continuously added to the secondary rinse tank 284 from the filtered water supply storage tank 218 as explained above. Alternatively, the process water may be circulated during the secondary rinse stage. The gas system components may remain, i.e., soak, in the secondary rinse tank 284 for any suitable period of time, e.g., from between five to thirty minutes, and preferably from between ten to fifteen minutes. Once the secondary rinse stage period is over, the components may be removed from the secondary rinse tank 284 in the gray room 200 and deposited into an airlock 106 which may be built into the airtight partition 104 of the trailer 102. The gas system components may be removed from the secondary rinse tank 284 and deposited into the airlock 106 by a technician or an automated system.

Both the primary and secondary rinse tanks 280, 284 may include agitation means to facilitate the rinsing process. The agitation means may include any suitable device for creating oscillatory or vibratory motion in the water.

An airlock 106 may be utilized to prevent contamination of the clean room 400 from any contaminants in the gray room 200. The airtight partition 104 and the airlock 106 preferably function to maintain the pressure differential between the two rooms 200 and 400, i.e., there is a positive pressure differential between the clean room 400 and the gray room 200 to ensure the proper level of cleanliness as discussed above. If the clean room 400 were to become contaminated by anything in the gray room 200, then the gas system components may become contaminated, thereby necessitating repeating the entire aqueous cleaning process. In the exemplary embodiment, the airlock 106 comprises a double door pass-through box. The doors of the pass-through box may be interlocked to prevent both doors from being opened at the same time. Typically, no inspections or tests are done after the secondary rinse stage.

The third step in the exemplary aqueous cleaning process is the final cleaning step. The final cleaning step comprises removing any residual deposits, preventing soil redeposition, and preparing the surfaces of the components for the final rinse step. The final cleaning step functions to prevent the redeposition of soil or other contaminants by an electro-chemical reaction between the second water soluble cleaning agent and the gas system components, as described in detail below. In the final cleaning step at the batch level, the gas system components are removed from the airlock 106 and deposited into a final cleaning tank 402 in the clean room 400. The gas system components may be removed from the airlock 106 and deposited into the final cleaning tank 402 by a technician or an automated system. The final cleaning tank 402 may be filled with a second water soluble cleaning agent or solution and no process water. Alternatively, the second water soluble cleaning agent may be mixed with the process water. If the mixture is utilized, the process water may be pumped from the second water processing heater 234 into the final cleaning tank 402. In the exemplary embodiment, the second water soluble cleaning agent may comprise Navy Oxygen Cleaning compound (NOC). NOC is a non-toxic, biodegradable cleaning agent which is compatible with metallic materials and many non-metallic materials. NOC is extremely effective in removing hydrocarbon oils, greases and fats, and fluorinated oils and greases. NOC is an inorganic alkaline solution comprising water, sodium silicate, sodium molybdate and sodium fluoroborate. Soil redeposition is prevented by an amorphous glass surface which may be formed on the surface of the gas system components which come into contact with the NOC. The second water soluble cleaning agent, whether used in diluted or concentrated form, shall be referred to as the water soluble final cleaning solution. In the exemplary embodiment, the final cleaning tank 402 may be a fifteen gallon tank; however, the final cleaning tank 402 may be of varying size to accommodate different applications. The final cleaning tank 402 may be filled with the water soluble final cleaning solution by an automatic dispenser or added manually by a technician. A submersible ultrasonic transducer may be mounted in the final cleaning tank 402 to facilitate the cleaning process via a scrubbing action generated by the implosion of cavitation bubbles. Additionally, the water soluble final cleaning solution may be continuously recirculated by a pump 404 which draws the water soluble final cleaning solution from the final cleaning tank 402 through a drain line 406 and circulates it through a heating unit 408, a first two-way valve 410, a second two-way valve 412, a filter 414, and back into the final cleaning tank 402. The recirculation of the water soluble final cleaning solution may facilitate the cleaning process.

In the exemplary embodiment, the pump 404 circulates the water soluble final cleaning solution at a rate of up to five gallons per minute and preferably at a rate of at least one gallon per minute. The heating unit 408, which preferably comprises a manifold heater raises, and maintains the temperature of the water soluble final cleaning solution at a value in the range of one hundred thirty-five to one hundred sixty-five degrees Fahrenheit, and preferably at a value in the range of one hundred forty-five to one hundred fifty-five degrees Fahrenheit for the most effective cleaning. The heating unit 408 may be connected to the output side of the pump 404 via a conduit 416. The first two-way valve 410 may be connected to the heating unit 408 via a conduit 418. The first two-way valve 410 may be manually actuated or automatically actuated. In either case, the first two-way valve 410 either directs the water soluble final cleaning solution to the second two-way valve 412 via a conduit 420 or to an on/off valve 314 via a conduit 422.

In batch or lot type cleaning, the water soluble final cleaning solution is recirculated through the second two-way valve 412, whereas if the gas system is to be cleaned as a whole, the water soluble final cleaning solution is directed to the on/off valve 314 for connection to an input or output of the gas system. The second two-way valve 412 may be identical to the first two-way valve 410, and either directs the water soluble final cleaning solution from the first two-way valve 410 via conduit 420, or from the gas system via a conduit 424 to the filter 414 via a conduit 426. In batch or lot type cleaning, the second two-way valve 412 directs the water soluble final cleaning solution from the first two-way valve 410 to the filter 414. The filter 414 comprises a Teflon®, stainless steel, or polypropylene filter which is operable to remove particulate matter in the half micron size from the final cleaning solution. The filter 414 may be connected to the final cleaning tank 402 via a conduit 428. A drain line 430 may be connected to the final cleaning tank 402 to drain the final water soluble cleaning solution from the final cleaning tank 402. An on/off valve 432 may be connected in-line with the drain line 430 to control the flow of final water soluble cleaning solution. The drain line 430 may be connected to the return line 272 for return to the aqueous waste collector tank 202 as explained above.

The gas system components may remain, i.e., soak, in the final cleaning tank 402 for any suitable period of time, e.g., from between five to thirty minutes, and preferably from between ten to fifteen minutes. After this time period, the components are removed from the final cleaning tank 402.

The fourth and final step in the exemplary aqueous cleaning process is the final rinse step. The final rinse step comprises removing all remaining residues and flushing the components to prevent redeposition of soil and formation of cleaning solution residue. To prevent the redeposition of soil and the formation of cleaning solution residue, the time between removing the components from the final clean tank 402 and placing them in the final rinse tank 434 preferably does not exceed two minutes, and more preferably does not exceed thirty seconds. In the final rinse step, the gas system components are removed from the final cleaning tank 402 and deposited into a final rinse tank 434 which is filled with process water only. As before, the gas system components may be removed from the final cleaning tank 402 and deposited into the final rinse tank 434 by a technician or an automated system. In the exemplary embodiment, the final rinse tank 434 may be a fifteen gallon tank; however, the final rinse tank 434 may be of any size to accommodate different applications. The final rinse tank 434 may be filled with process water via the conduit 248 connected to the second heater 234 and an on/off valve 253. The on/off valve 253 may be utilized to control the flow rate of the process water into the final rinse tank 434. The flow rate into the final rinse tank 434 may be no greater than one gallon per minute and preferably a half gallon per minute. The on/off valve 253 may be a manually actuated valve or an automatically actuated valve. A drain line 436 may be connected between the final rinse tank 434 and the return line 272 through an on/off valve 438 for returning the process water to the aqueous waste collector tank 202 as explained above. Additionally, an overflow line 440 may be connected between the final rinse tank 434 and the return line 272. Accordingly, the components in the final rinse tank 434 are continuously rinsed with fresh process water supplied via conduit 248 at the flow rate stated above. The temperature of the process water is preferably maintained at a value in the range of one hundred ten to one hundred eighty degrees Fahrenheit, and preferably at a value in the range of 110 to 120 degrees Fahrenheit by the second water processing heating unit 234. The gas system components remain, i.e., soak, in the final rinse tank 434 any suitable period of time, e.g., until the process water exiting the final rinse tank 434 has a pH of about 8.0 or less, but preferably not less than thirty seconds from deposition in the final rinse tank 434.

The process water may be collected for pH testing in an effluent container 442. The effluent container 442 may be connected to the final rinse tank 434 via a conduit 444. The pH of the process water in the effluent container 442 may be analyzed via plastic pH probes, litmus paper, phenolphthalein indicator solution, or any other suitable means. If the process water is of a pH of 8.0 or less, the components may be removed from the final rinse tank 434. The pH testing may be accomplished by an automated process.

In order to determine if the gas system components have been cleaned to the various exacting military and commercial standards, a sample of the final rinse tank effluent is preferably collected and analyzed. For example, a five hundred to six hundred milliliter sample of the final rinse effluent may be drawn from the effluent container 442. The sample of effluent is then subjected to a particulate test, wherein the effluent is examined for certain particulate matter. Essentially, the sample of effluent may be passed through a filter and the filter is examined or inspected for the presence of particulate matter in the form of non-volatile residue. The particulate matter size and quantity is analyzed with respect to any suitable specifications. The presence of particulate matter may also be determined by gravimetric analysis. Basically, after the effluent is passed through the filter, the filter is dried, and weighed. The weights of the filter before and after filtration of the effluent are then compared. The increase in the weight of the filter is a measure of the non-volatile residue in the effluent. If the effluent is within the predetermined specified parameters, the gas system components are considered "clean" and subjected to post cleaning processes. If, however, the effluent is not within tolerance, then the components may be placed back into the final clean tank 402 for a repeat of the last two steps or back into the pre-cleaning tank 246 for a repeat of the entire process. It should be noted that the testing need not be limited to after the final rinse step, but rather, it may be done after the final cleaning step. Alternatively, the testing may be done after both steps. Additionally, the testing may be accomplished by an automated process.

The post-cleaning processes include drying of the gas system components, laminar flow assembly, testing, and packaging, labelling and/or installing the components in the gas system. The gas system components may be dried utilizing an inert gas such as nitrogen supplied by a nitrogen gas supply 446, and an oven 448. The components are subjected to a stream of warm nitrogen gas supplied by the nitrogen gas supply 446 and then placed in the oven 448 for no more than one hundred twenty minutes and preferably no more than ninety minutes. The oven temperature may be at least one hundred twenty-five degrees Fahrenheit, and preferably not less than one hundred fifty degrees Fahrenheit. The gas system components may then be removed from the oven 448 and assembled on a laminar flow bench 450 if any assembly is required. The laminar flow bench comprises a means for directing filtered air over the components on the table to preclude dust particles from settling on the clean components during assembly. The components and/or assemblies are then functionally tested in a functional test work station 452. The functional test work station may comprise an altitude chamber, pressure gauges, flow meters, valves and other devices and systems required to perform all necessary testing depending on the application. The tested components are then packaged and labelled at a packaging work station 454, or installed in the gas system directly.

As stated above, the first step in the aqueous cleaning process is the pre-cleaning step. However, if the particular gas system component is a pressure vessel, for example, a pressurized gas cylinder, then the component may be subjected to a pre-test before the pre-cleaning step. The particular pressure vessel may be positioned in a permanent volumetric expansion test unit (PET) 316. In the permanent volumetric expansion test unit 316, the pressure vessel may be filled with water from the filtered water supply storage tank 218 via conduit 352. This water may be utilized so as not to add any contaminants. The PVET unit 316 may comprise a pump which draws the water from the filtered water supply storage tank 218 and pumps it into the particular pressure vessel at a predetermined pressure. Nominally, this pressure is 5/3 of the working pressure of the vessel. Components are subject to PVET periodically in accordance with various commercial, military and federal standards. If the component passes the PVET, then it may be placed in the pre-clean tank 246 and cleaned according to the above-described process.

As discussed briefly above, the various steps in the aqueous cleaning process may be automated. In addition to the gas system components being automatically moved from one step to the next, all of the elements of the aqueous cleaning system, including the pumps, heaters and valves, may be automatically controlled and monitored. For example, a computer preprogrammed with the entire aqueous cleaning process, may control the process while a technician may perform the necessary verification tests. Alternatively, the computer may also control a system for automatically implementing the verification tests.

SYSTEM LEVEL CLEANING

As stated above, the aqueous cleaning process requires the same four basic steps in either batch or whole system cleaning. The specific implementations of these steps, however, may be different for each type of cleaning, thereby involving different and additional aqueous cleaning system elements. The process water and water soluble cleaning agents or solutions utilized may be the same.

The first step in the exemplary aqueous cleaning process is the per-cleaning step. As described with respect to batch type cleaning, the water soluble pre-cleaning solution in the pre-cleaning tank 246 may be recirculated, after filtering and heating, back into the pre-cleaning tank 246 via the two-way valve 258 or to the on/off valve manifold 266 via the conduit 268. In whole system cleaning, the two-way valve 258 ports the water soluble pre-cleaning solution to a first on/off valve 318 in the on/off valve manifold 266. A conduit 320 having one end connected to the on/off valve 318 may be connected through a three-way valve 322 to an input or output of the gas system 500 which is represented in FIG. 2 as an aircraft. The connection to the gas system 500 may be made via a hose 324 and any suitable hose connection means such as a hose clamp or a threaded connector.

The water soluble pre-cleaning solution may be pumped through the gas system 500 at a minimum velocity of three dt/sec by pump 250 to ensure that no soil redeposition may occur. The flow rate in gallons per minute equivalent to three dt/sec is a function of the inside diameter of the conduit or tubing through which the solution is pumped. For example, in a 5/16 inch inside diameter pipe, the flow rate is preferably ¾ gallon per minute, for a ⅜ inch inside diameter pipe, the flow rate is preferably one gallon per minute, and for a ½ inch diameter pipe, the flow rate is preferably two gallons per minute. The water soluble pre-cleaning solution exiting the gas system 500, i.e., the contaminated water soluble pre-cleaning solution, exits the gas system 500 via a hose 326 and flows through a three-way valve 328 to an on/off valve 330 in an on/off valve manifold 332 via a conduit 334. The return line 272 may be connected to the on/off valve 330 through a two-way valve 468 and conduit 462 for returning the contaminated water soluble pre-cleaning solution to the aqueous waste collector tank 202. The gas system may be flushed with the water soluble pre-cleaning solution for any suitable period of time, e.g., at least thirty minutes if the gas system comprises tubing incorporating only bends and/or elbows. Otherwise, the gas system may be flushed for a minimum time of sixty minutes. Gas systems having other components may preferably be back-flushed for a minimum time of sixty minutes. No back-flushing is required in gas systems having tubing with only elbows and bends because elbows and bends present relatively smooth transitions which do not develop areas of stagnant flow like blank fittings and valves. Back-flushing may be accomplished by simply switching the connections of the two hoses 324 and 326, for example, if hose 324 is connected to the input of the gas system 500 and hose 326 is connected to the output of the gas system 500, then back-flushing may be facilitated by switching hose 324 to the output and hose 326 to the input of the gas system 500. Alternatively, back-flushing may be accomplished by utilizing a reversible flow pump. The temperature of the water soluble pre-cleaning solution, whether for flushing or back-flushing, may be maintained in a range of one hundred ten to one hundred eighty degrees Fahrenheit, and preferably in a range of one hundred ten to one hundred twenty degrees Fahrenheit by the heater 254 for effective cleaning, and the water soluble pre-cleaning solution may be filtered by filter 256. Once the pre-cleaning step is complete, the first on/off valve 318 is closed and a second on/off valve 336 of the on/off valve manifold 266 is open for the rinsing step. All valves may be manually actuated or automatically actuated.

The second step in the exemplary aqueous cleaning process is the rinse step which as with batch type cleaning preferably comprises the primary rinse stage and the secondary rinse stage. In the primary rinse stage, as described with respect to the batch type cleaning, the process water in the primary rinse tank 280 may be recirculated, after filtering and heating, back into the primary rinse tank 280 via the two-way valve 294 or to the on/off valve manifold 266 via the conduit 302. In whole system cleaning, the two-way valve 294 ports the process water to the second on/off valve 336 of the on/off valve manifold 266. The second on/off valve 336 is connected to the conduit 320 which is connected through the two-way valve 322 to the gas system 500 via the hose 324.

The process water may be pumped through the gas system 500 at a minimum velocity of three dt/sec. The process water exiting the gas system 500 exits via the hose 326 and flows through the three-way valve 328 to the on/off valve 330 via the conduit 334. The gas system 500 may be flushed and back-flushed for the same time periods and under the same conditions as in the pre-cleaning step described above. For example, flushing may require a duration of thirty minutes or sixty minutes depending upon the type of system components, back-flushing may or may not be required depending upon the system components, and the process water may be heated to a temperature in the range of one hundred ten to one hundred eighty degrees Fahrenheit, and preferably in the range of one hundred ten to one hundred twenty degrees Fahrenheit and filtered. The valves may be manually actuated or automatically actuated.

In the secondary rinse stage, a pump 338 draws the process water from the secondary rinse tank 284 through a conduit 340 and pumps it to a third on/off valve 342 in the on/off valve manifold 266. The third on/off valve 342 is connected to the conduit 320 which is connected through the three-way valve 322 to the gas system 500 via the hose 324.

The process water may be pumped through the gas system 500 at a minimum velocity of three dt/sec. The process water exiting the gas system 500 exits via the hose 326 and flows through the three-way valve 328 to the on/off valve 330 via the conduit 334. The gas system 500 may be flushed and back-flushed for the same time periods and under the same conditions as in the primary rinse step described above. In addition, the process water is maintained at a temperature in the range of one hundred ten to one hundred eighty degrees Fahrenheit, and preferably in the range of 110 to 120 degrees Fahrenheit by the second water processing heating unit 234. The valves may be manually actuated or automatically actuated.

The third step in the exemplary aqueous cleaning process is the final cleaning step. As described with respect to batch type cleaning, the water soluble final cleaning solution in the final clean tank 402 may be recirculated, preferably after filtering and heating, back into the final cleaning tank 402 via the first two-way valve 410 or to the on/off valve 314 via conduit 422. In whole system cleaning, the first two-way valve 410 ports the water soluble cleaning solution to the on/off valve 314. A conduit 344 having one end connected to the on/off valve 314 may be connected through the three-way valve 322 to the gas system 500 via the conduit 324.

The water soluble final cleaning solution may be pumped through the gas system 500 at a minimum velocity of three dt/sec. The water soluble final cleaning solution exiting the gas system 500 exits via the hose 326 and flows through the three-way valve 328 to a second on/off valve 346 of the on/off valve manifold 332 via a conduit 348. The conduit 424 is connected to the on/off valve 346, which provides a fluid flow path for the water soluble final cleaning solution back to the final clean tank 402. The gas system 500 may be flushed and back-flushed with the water soluble final cleaning solution for the same time periods and under the same conditions as in the pre-cleaning step described above. In addition, as is the case with batch type cleaning, the temperature of the water soluble final cleaning solution may be maintained in a range between one hundred thirty-five to one hundred sixty-five degrees Fahrenheit and preferably between one hundred forty-five to one hundred fifty-five degrees Fahrenheit for effective cleaning. The valves may be manually actuated or automatically actuated.

The fourth and final step in the exemplary aqueous cleaning process is the final rinse step. In the final rinse step, a pump 456 draws the process water from the final rinse tank 434 through a conduit 458 and pumps it to a fourth on/off valve 350 in the on/off valve manifold 266. The fourth on/off valve 350 is connected to the conduit 320 which is connected through the three-way valve 322 to the gas system 500 via the hose 324.

The process water may be pumped through the gas system 500 at a minimum velocity of three dt/sec. The process water exiting the gas system 500 exits via the hose 326 and flows through the three-way valve 328 to the on/off valve 300 via the conduit 334. The gas system 500 may be flushed and back-flushed for the same time periods and under the same conditions as in the pre-cleaning step as described above. In addition, as in batch cleaning, the final rinse step is preferably commenced within two minutes after completion of the final cleaning step and more preferably commenced within 30 seconds to avoid the redeposition of contaminants and prevent water soluble cleaning agent residue from forming. The valves may be manually actuated or automatically actuated.

After the flushing, back-flushing steps of the aqueous cleaning process are complete, a sample of the process water may be collected in an effluent container 460. The effluent container 460 may be connected to the on/off valve 330 by the conduit 462. As the case with the batch type cleaning, the pH of the sample is tested. If the process water is of a pH of 8.0 or less, the final rinse step is complete. If the pH is not 8.0 or less, the final rinse step may be repeated.

As before, in order to determine if the gas system components have been cleaned to the various exacting military and commercial standards, a sample of the final rinse tank effluent is collected and analyzed. A five hundred to six hundred milliliter sample of the final rinse effluent may be drawn from the effluent container 460. The sample of effluent is then subjected to a particulate test, wherein the effluent is examined for particulate matter. Essentially, the sample of effluent may be passed through a filter and the filter is examined or inspected for the presence of particulate matter in the form of non-volatile residue. The particulate matter size and quantity shall not exceed the specified requirements. The presence of particulate matter may be determined by gravimetric analysis. Basically, after the effluent is passed through the filter, then the filter is dried, and weighed. The increase in the weight of the filter is a measure of the non-volatile residue in the effluent. If the effluent is within the predetermined specified parameters, the gas system may be considered "clean" and subjected to post cleaning processes. If, however, the effluent is not within tolerance, then the gas system 500 may be subjected to the last two steps of the process again, or to the entire aqueous cleaning process. As is the case with batch type cleaning, the verification tests may be performed after the final cleaning step, or after the final cleaning step and after the final rinse step.

The post cleaning process in whole system cleaning typically includes the drying step. Nitrogen gas from the nitrogen supply 446 is ported via a conduit 466 through a heater 464 to the three-way valve 322 for drying the gas system 500. The temperature of the nitrogen gas may be between one hundred twenty-five and one hundred fifty degrees Fahrenheit.

As discussed with respect to batch type cleaning, PVET may be required prior to the pre-cleaning step. Generally, the particular pressure vessel being tested would have to be removed from the gas system. Therefore, this particular component may then be cleaned as part of the batch type aqueous cleaning process. In addition, as noted for batch type cleaning, the entire aqueous cleaning process for whole system cleaning may be automated.

Figure 3:
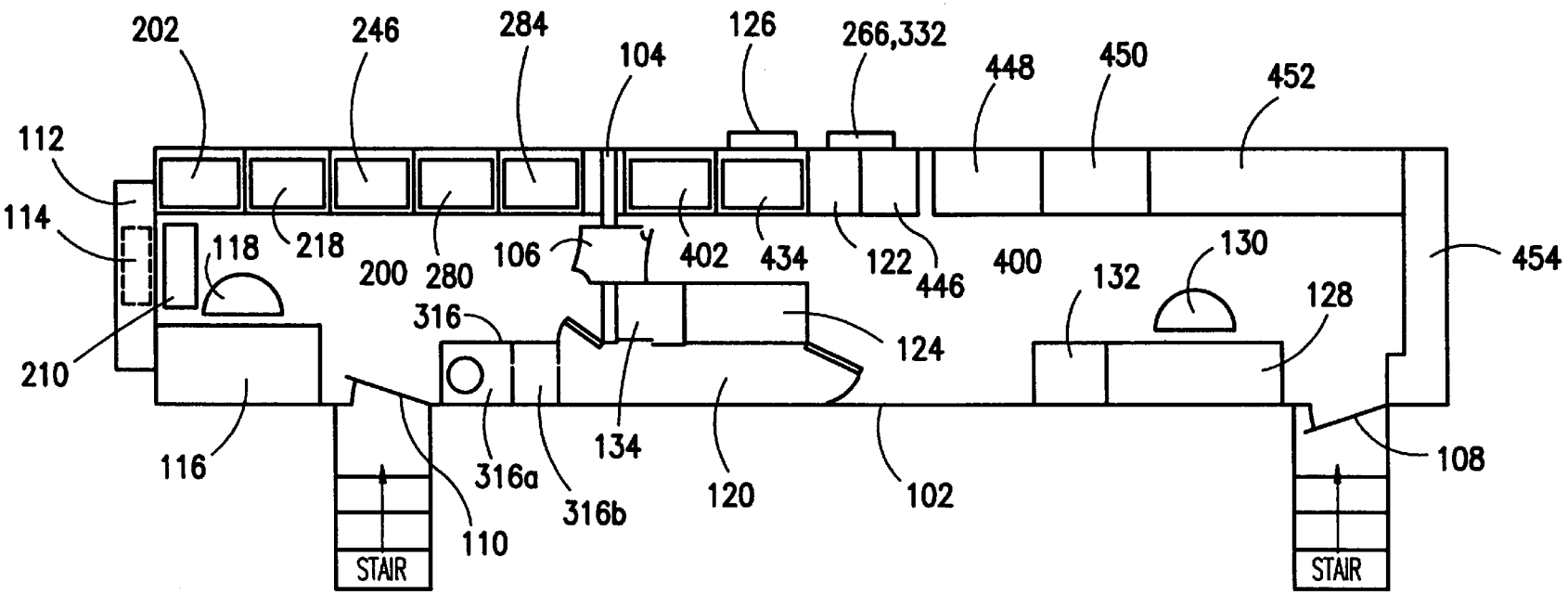
FIG. 3 is a schematic diagram of the portable, self-contained aqueous cleaning system of the present invention.

FIG. 3 is a schematic representation of the organization of the exemplary embodiment of the portable, self-contained aqueous cleaning system within the trailer 102. The trailer 102 may be a standard eight by forty foot trailer. The trailer 102 comprises an emergency entrance/exit 108, a regular entrance/exit 110, an air conditioning unit 112, and an electric generator 114. The air conditioning unit 112 is provided to maintain the trailer 102 at a comfortable working temperature and at the appropriate operating pressures.

The electric generator 114 may be utilized as a backup in case of power failure, or as primary power source in remote sites.

As stated previously, the trailer 102 may be divided into two rooms, the gray room 200 and the clean room 400 which are separated by the airtight partition 104. The gray room 200 comprises the filtered water supply storage tank 218, the nanofiltration system 210, the aqueous waste collector tank 202, the pre-cleaning tank 246, the primary rinse tank 280, the secondary rinse tank 284, and the permanent volumetric expansion test unit 316, including a PVET tank 316*a* and console 316b, and all associated piping, pumps, heaters, filters and valves. Additionally, the gray room 200 may be equipped with a desk 116 and chair 118. Gas system components may be passed from the gray room 200 into the clean room 400 utilizing the airlock 106, and people may pass from the gray room 200 to the clean room 400 through a larger airlock 120.

The clean room 400 comprises the final cleaning tank 402, the final rinse tank 434, a drain board 122 for partially drying gas system components removed from the final rinse tank 434, the nitrogen purge gas supply 446, the oven 448, the laminar flow assembly work station 450, the functional test work station 452, the packaging work station 454, a cleanliness verification work station 124, and all associated piping, pumps, heaters, filters and valves. The clean room 400 also comprises a master control panel 126, and the on/off valve manifolds 266 and 332 for connecting the aqueous cleaning system 100 to the gas system for whole system cleaning. Additionally, the clean room 400 may comprise a desk 128, a chair 130, a file storage cabinet 132 and a closet 134.

The clean room 400 may be maintained at the desired level of cleanliness (preferably having a particulate concentration not to exceed one half micron particle per cubic foot of air) by the air conditioning unit 112. The air conditioning unit 112 may comprise a filter operable to remove half micron and larger particles from the air in the clean room 400. Additionally, the air conditioning unit 112 may be utilized to maintain the clean room 400 at a slightly higher pressure than the gray room 200. This pressure differential may prevent contamination of clean room 400 in case of an accidental breech of clean room 400 integrity. Basically, if the clean room 400 was accidentally exposed to the ambient environment or to the gray room 200, the positive pressure differential in the clean room 400 would generate a barrier to airborne contaminants. The gray room 200 may also be kept at a slightly higher pressure than the ambient environment, but less than the clean room 400. This positive pressure differential may keep out additional contaminants.

Figure 4:
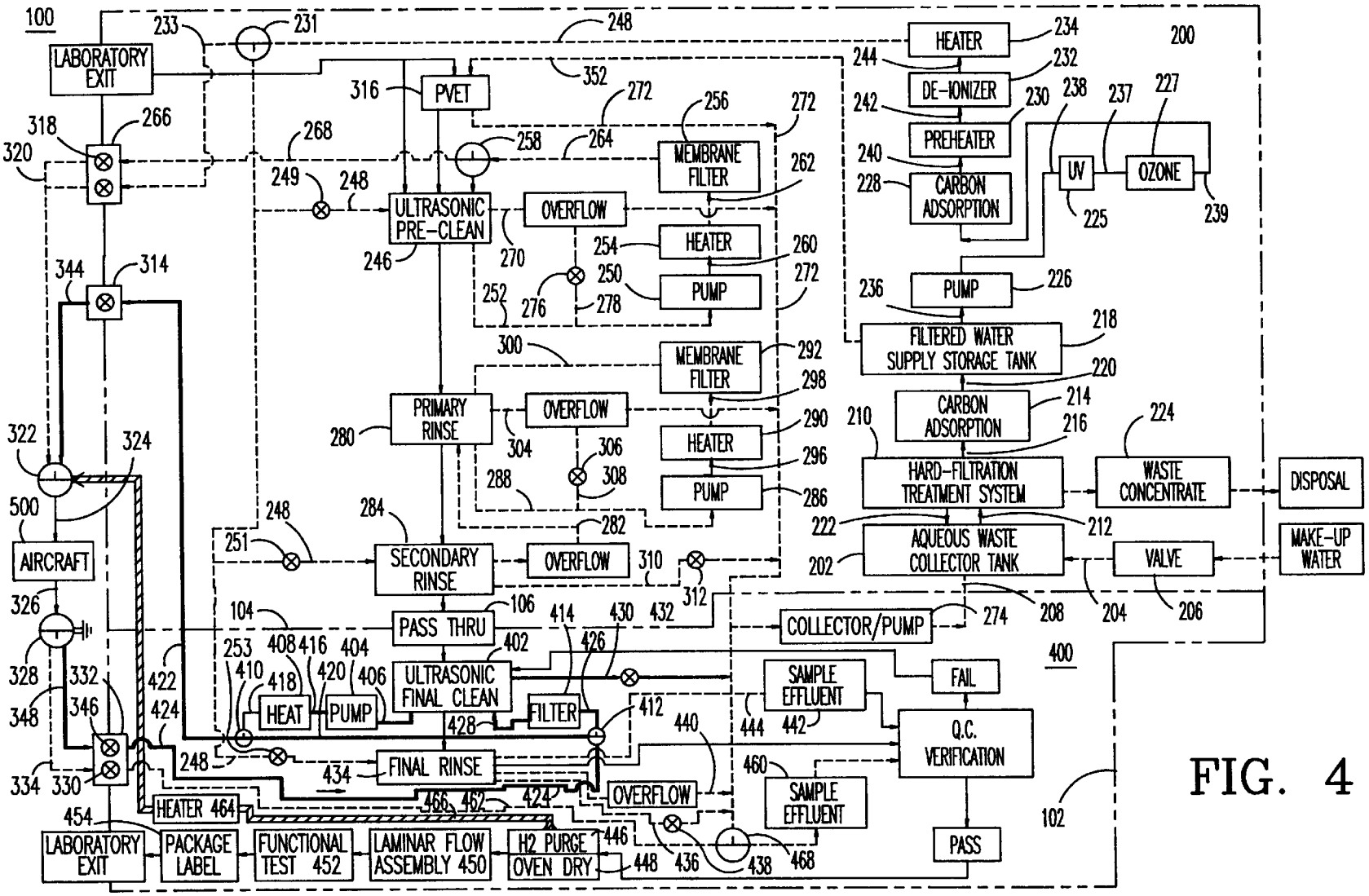
FIG. 4 is a block diagram of an alternate embodiment of the portable self-contained aqueous cleaning system of the present invention.

FIG. 4 is a block diagram illustrating an exemplary alternate embodiment of the aqueous cleaning system 100. The same reference numerals as used in FIG. 2 are utilized in FIG. 4 for identical elements. The exemplary alternate aqueous cleaning system 100 of FIG. 4 is identical to the system illustrated in FIG. 2 for implementing a batch level cleaning process. The alternate aqueous cleaning system 100, however, is different for implementing in situ whole system level cleaning. In the embodiment of FIG. 4, the primary and secondary rinse stages are combined into a single rinse step and the process water utilized for rinsing may be drawn directly from the second water processing heating unit 234 via conduit 248 instead of from the primary and secondary rinse tanks 280 and 284 as described with reference to FIG. 2. A three-way valve 231 connected in line with conduit 248 either ports the process water to the various tanks 246, 280, 284, 402, 434 or to the on/off valve 336 in the on/off valve manifold 266 via conduit 233. Accordingly, whereas each rinsing stage for in situ cleaning described above was for thirty or sixty minutes, the rinsing step may now be sixty minutes or one hundred twenty minutes, i.e., double the time of each stage described previously. In addition, the process water for the final rinse may also be drawn directly from the second water processing heating unit 234 and ported through conduit 233. The final rinse step may be for the same duration as the final rinse step described above with reference to FIG. 2.

Although shown and described is what is believed to be the more practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A apparatus for cleaning fluid systems and fluid system components comprising:

a system housing having first and second compartments, the first compartment including a fluid outlet assembly adapted for coupling to a fluid system and the second compartment including a fluid inlet assembly;

a first cleaning assembly including a first cleaning tank disposed in the first compartment and cooperatively arranged to contact fluid systems and fluid system components with a water soluble pre-cleaning solution including water and a water soluble cleaning agent to remove contaminants form fluid systems and fluid system components, and including a first fluid driving unit having an inlet coupled to the first tank and an outlet coupled to the first tank and to the fluid outlet assembly of said first compartment to draw the water soluble pre cleaning solution from the first cleaning tank and to selectively drive the water soluble pre cleaning solution to one of the fluid outlet assembly and the first cleaning tank;

a second cleaning assembly including a second cleaning tank disposed in the second compartment and cooperatively arranged to contact the fluid system and fluid system components with a water soluble final cleaning solution to remove contaminants from the fluid systems and fluid system components, and including a second fluid driving unit having an inlet coupled to the second tank and an outlet coupled to the second tank and to the fluid outlet assembly of said first compartment to draw the water soluble final cleaning solution from the second cleaning tank and to selectively drive the water soluble final cleaning solution to one of the fluid outlet assembly and the second cleaning tank; and a rinsing assembly including 1) a first rinsing tank disposed in the first compartment and adapted to receive purified water, 2) a fluid driving having an inlet coupled to the first rinsing tank and an outlet coupled to the first rinsing tank and to the fluid outlet to draw the purified water from the first rinsing tank and to selectively drive the purified water to one of the first rinsing tank and the fluid outlet assembly, 3) a final rinsing tank disposed in the second compartment and adapted to receive purified water, and 4) a pump coupled to the final rinse tank to drive the purified water from the final rinse tank to the fluid outlet assembly components with a rinsing solution including water to remove contaminants, the water soluble pre-cleaning solution, and the water soluble final cleaning solution from the fluid systems and fluid system components.

2. The apparatus of claim 1 further comprising means for establishing and maintaining a positive pressure differential between the second compartment and the first compartment.

3. The apparatus of claim 2 further comprising means for establishing and maintaining a positive pressure differential between the first compartment and the ambient environment.

4. The apparatus of claim 1 wherein the fluid outlet assembly includes a plurality of valves wherein each of said first cleaning assembly, said second cleaning assembly and said rinsing assembly are connected to respective ones of the plurality of valves.

5. The apparatus of claim 1 wherein the fluid inlet assembly is in fluid communication with the second cleaning tank and the fluid inlet assembly a plurality of valves.

6. The apparatus according to claim 1 further comprising a dryer disposed within said housing and associated with said second cleaning assembly cooperatively arranged therewith to dry the fluid systems and fluid system components.

7. The apparatus according to claim 1, wherein the first cleaning assembly includes a first purification unit having a heater and a filter in fluid communication with the first fluid driving unit to purify the water soluble pre-cleaning solution.

8. The apparatus according to claim 7, wherein the first fluid driving unit comprises a pump for pumping the water soluble pre-cleaning solution through the filter to remove filterable impurities from the solution and through the heater for heating the pre-cleaning solution, and a two-way valve having an inlet coupled to the first purification unit and an output connected to the first cleaning tank and the fluid outlet assembly.

9. The apparatus according to claim 1, wherein the second cleaning assembly comprises a second purification unit comprising a filter in fluid communication with the second fluid driving unit to purify the water soluble pre-cleaning solution.

10. The apparatus according to claim 9, wherein the second fluid driving unit comprises a heater, a two-way valve disposed downstream from the heater having an inlet in fluid communication with the heater and having an outlet in fluid communication with the fluid outlet assembly and the second purification assembly and a pump for drawing the water soluble final cleaning solution from the second tank and driving the water soluble final cleaning solution to the two-way valve.

11. The apparatus according to claim 1, further comprising a water processing assembly including:

(a) a pump for drawing process water from a source;

(b) an adsorption bed disposed downstream from and in fluid communication with the pump for removing bacterial and chemical contaminants from the process water;

(c) a de-ionizing filter located downstream from the adsorption bed;

(d) a heater for raising the temperature of the process water disposed downstream from said de-ionizing filter in fluid communication with the first cleaning tank.

12. The apparatus for cleaning fluid systems and fluid system components of claim 1 wherein said water processing assembly is coupled to the fluid outlet assembly to provide purified rinse water to the fluid outlet assembly.

13. The apparatus for cleaning fluid systems and fluid system components of claim 1 further comprising a second rinse tank disposed in the first compartment in fluid communication with the first rinse tank.

14. The apparatus for cleaning fluid systems and fluid system components of claim 1 further comprising a fluid driving unit and a purification unit disposed downstream from the fluid driving unit, the fluid driving unit having an inlet coupled to the first rinse tank and an outlet coupled to the purification unit, the purification unit having an outlet coupled to the first rinse tank.

15. The apparatus for cleaning fluid systems and fluid system components of claim 1 wherein the outlet of purification unit is connected to the fluid outlet assembly of the first compartment.

16. The apparatus for cleaning fluid systems and fluid system components of claims 1 wherein the first and second fluid driving unit circulates the water soluble pre cleaning solution and final cleaning solution, respectively, at a velocity of at least 3 ft/sec.

17. The apparatus for cleaning fluid systems and fluid system components of claim 11 wherein the heater is in fluid communication with the fluid outlet assembly.

18. The apparatus for cleaning fluid systems and fluid system components of claim 1 further comprising an effluent container connected to the second rinse tank.

19. A cleaning system for removing water soluble contaminants from fuel systems and fuel system components where said cleaning system comprises:

(a) a first cleaning assembly cooperatively arranged to contact the fuel systems or fuel system components with a pre-cleaning solution comprising water and a water soluble cleaning agent to remove contaminants from the fuel system or fuel system components, the first cleaning assembly including a first container adapted to hold the water soluble per-cleaning solution and the fuel system components, a first purification assembly connected to and communicating with the first container to purify the water soluble pre-cleaning solution and a first flushing unit connected to the first purification unit including means for selectively driving the water soluble pre-cleaning solution through the purification assembly to one of an outlet and the first container;

(b) a second cleaning assembly cooperatively arranged to contact the fuel systems or fuel system components with a water soluble final cleaning solution to remove contaminants from the components, the second cleaning assembly including a second container adapted to hold the water soluble final cleaning solution and the fuel systems and fuel system components, a second purification assembly connected to and communicating with the second container to purify the water soluble final cleaning solution and a second flushing unit connected to the second purification assembly including means for selectively driving the water soluble final cleaning solution through the second purification assembly to one of the outlet and the second container;

(c) a rinsing assembly cooperatively arranged to rinse the fuel systems or fuel system components with a rinsing solution comprising water to remove contaminants, the water soluble pre-cleaning solution, or the water soluble final cleaning from the fuel systems or fuels system components said rinsing assembly being in fluid communication with the outlet; and (d) a water processing assembly cooperatively arranged to purify the used cleaning and rinsing solutions to generate purified water and reduced-volume waste, the water processing assembly being connected to and communicating with the first cleaning assembly, and the rinsing assembly.

20. The cleaning system according to claim 19, wherein the first cleaning assembly comprises an agitator operable to agitate the contents of the first cleaning tank.

21. The cleaning system according to claim 19, wherein the second cleaning assembly comprises an agitator operable to agitate the contents of the second cleaning tank.

22. The cleaning system according to claim 19, wherein the first purification assembly comprises a filter, a pump for pumping the water soluble pre-cleaning solution through the filter to remove filterable impurities from the solution, and a heater for heating the pre-cleaning solution prior to contacting the components in said first cleaning assembly.

23. The cleaning system according to claim 19, wherein the second purification assembly comprises a filter, a pump for pumping the water soluble pre-cleaning solution through the filter to remove filterable impurities from the solution, and a heater for heating the pre-cleaning solution prior to contacting the components in said second cleaning assembly.

24. The cleaning system according to claim 19, wherein the rinsing assembly comprises:

(a) a primary rinse assembly including a primary rinse container and a third purification assembly connected to and communicating with the primary rinse container to purify the rinse solution and to return the purified rinse solution to the primary rinse container;

(b) a secondary rinse assembly including a secondary rinse container; and (c) a final rinse assembly including a final rinse container.

25. The cleaning system according to claim 24, wherein the third purification assembly comprises a filter, a pump for pumping the water soluble pre-cleaning solution through the filter to remove filterable impurities from the solution, and a heater for heating the pre-cleaning solution prior to contacting the components in said final rinse assembly.

26. The cleaning system according to claim 19 further comprising a dryer assembly cooperatively arranged to dry the components.

27. The cleaning system according to claim 26 further comprising a waste concentrate container connected to and communicating with the water processing assembly, the waste concentrate container being operable to collect the reduced-volume waste.

28. The cleaning system according to claim 27, wherein the water processing assembly comprises:

(a) at least one filter for removing contaminants, the water soluble pre-cleaning solution, and the water soluble final cleaning solution from the used cleaning and rinsing solutions;

(b) an absorption bed for removing bacterial and chemical contaminants; and (c) a heater for raising the temperature of the water.

29. The cleaning system according to claim 28 further comprising a trailer having a clean room and a gray room, the clean room including a first pressure and the gray room including a second pressure, the first pressure being sufficiently greater than the second pressure to generate a barrier to airborne contaminants and wherein the cleaning system is self-contained and disposed in the trailer, the clean room housing at least the final cleaning assembly and the dryer, and the gray room housing at least the pre-cleaning assembly, the rinsing assembly, the water processing assembly, and the waste concentrate container.

30. The cleaning system according to claim 29 further comprising a permanent volumetric expansion test unit coupled to said water processing assembly.

* * * * *